US005080598A

United States Patent [19]

Shotey

[11] Patent Number: 5,080,598

[45] Date of Patent: Jan. 14, 1992

[54] SELF SEALING SHEATH FOR ELECTRICAL WALL OUTLETS

[76] Inventor: Michael J. Shotey, 7733 E. Cypress, Scottsdale, Ariz. 85257

[21] Appl. No.: 662,751

[22] Filed: Mar. 1, 1991

Related U.S. Application Data

[63] Continuation-in-part of Ser. No. 596,778, Oct. 12, 1990, Pat. No. 5,041,000.

[51] Int. Cl.[5] ..... H01R 13/44

[52] U.S. Cl. ..... 439/147; 174/67; 439/367; 439/373

[58] Field of Search ..... 439/140, 147, 367, 371-373, 439/366, 577, 750, 892, 893; 174/67

[56] References Cited

U.S. PATENT DOCUMENTS

| | | | |
|---|---|---|---|
| 2,458,153 | 1/1949 | Festge | 173/361 |
| 2,709,198 | 5/1955 | Holtshouser | 174/67 |
| 2,893,172 | 6/1959 | McGann, Jr. | 339/36 |
| 3,363,216 | 1/1968 | Benedetto | 339/39 |
| 3,449,706 | 6/1969 | Carissimi | 339/94 |
| 3,597,526 | 8/1971 | Bostwright | 174/66 |
| 3,639,886 | 2/1972 | Drapkin | 339/66 |
| 4,076,360 | 2/1978 | Singh | 339/36 |
| 4,109,095 | 8/1978 | Kling et al. | 174/67 |
| 4,424,407 | 1/1984 | Barbic | 174/67 |
| 4,484,185 | 11/1984 | Graves | 340/656 |
| 4,531,800 | 7/1985 | Arener | 439/373 |
| 4,605,817 | 8/1986 | Lopez | 174/67 |
| 4,691,974 | 9/1987 | Pinkerton | 439/147 |
| 4,718,856 | 1/1988 | Pinkerton et al. | 439/147 |
| 4,803,307 | 2/1988 | Shotey | 174/67 |
| 4,869,683 | 9/1989 | Nelson | 439/367 |
| 4,921,442 | 5/1990 | Sato | 439/521 |
| 4,944,685 | 7/1990 | Schulte | 439/367 |

FOREIGN PATENT DOCUMENTS

| | | | |
|---|---|---|---|
| 1567175 | 5/1980 | United Kingdom | 439/147 |

*Primary Examiner*—Paula A. Bradley
*Attorney, Agent, or Firm*—Cahill, Sutton & Thomas

[57] ABSTRACT

A sheath, detachably attachable to a faceplate surrounding an electrical outlet, receives and shields an electrical plug plugged into the electrical outlet. One end of the sheath is constrictable to secure the sheath to the faceplate and the other end is constrictable about the cord extending from the electrical plug.

13 Claims, 2 Drawing Sheets

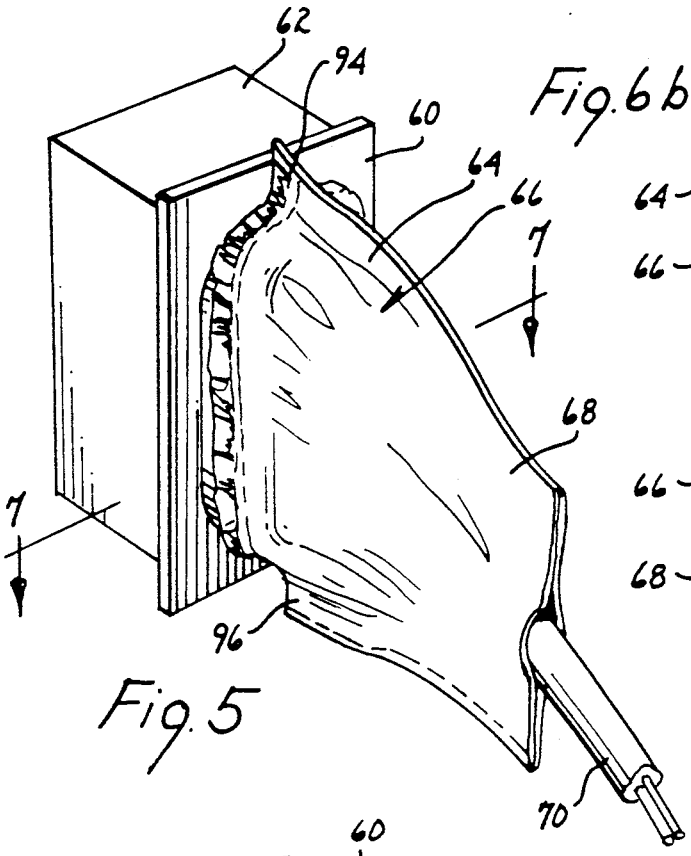
Fig. 5
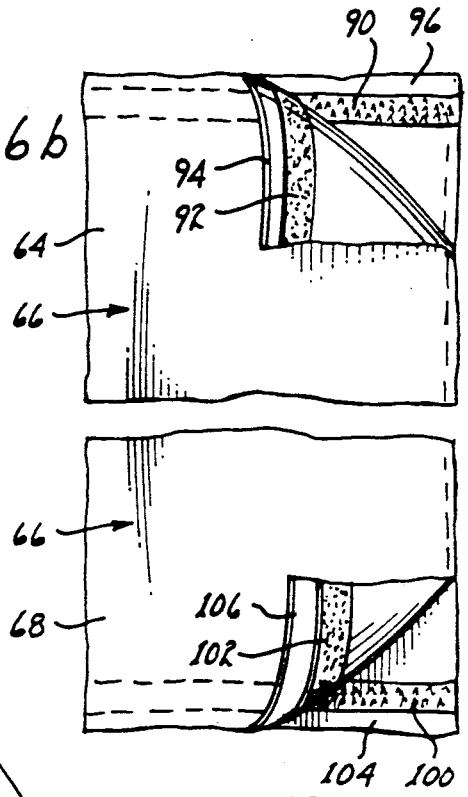
Fig. 6b
Fig. 6a
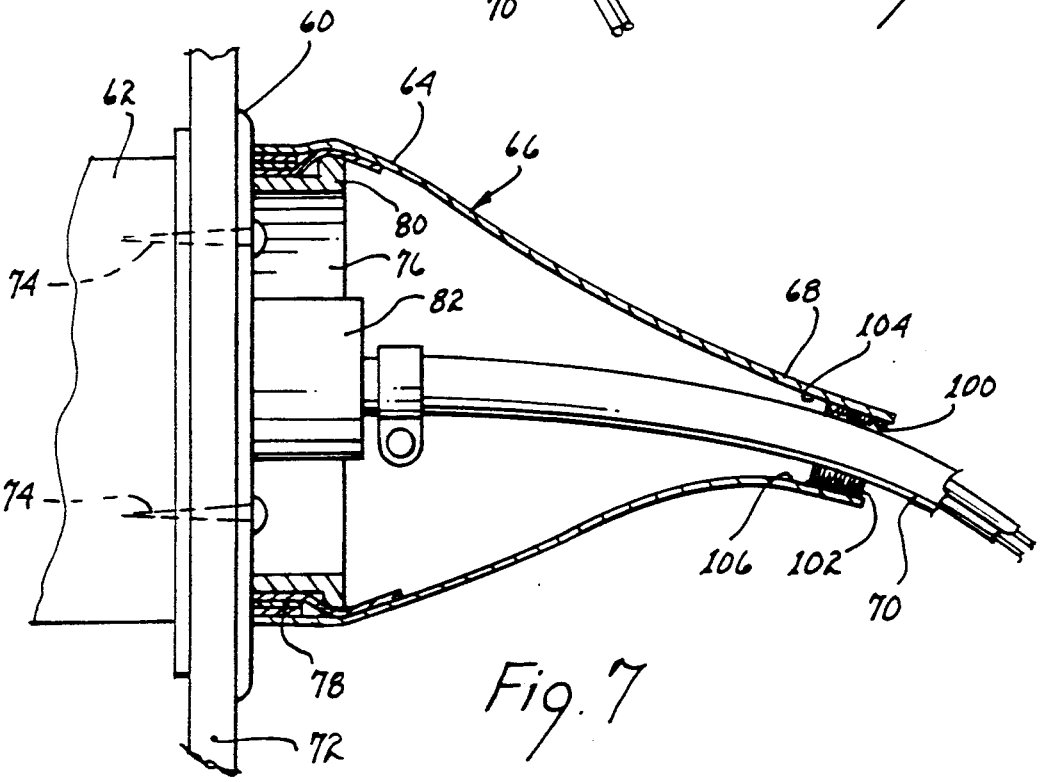
Fig. 7

SELF SEALING SHEATH FOR ELECTRICAL WALL OUTLETS

CROSS REFERENCE TO RELATED APPLICATION

The present application is a continuation in part application of a patent application entitled "Shroud For Electrical Wall Outlets", filed Oct. 12, 1990, assigned Serial No. 07/596,778, now U.S. Pat. No. 5,041,000.

BACKGROUND OF THE INVENTION

1. Field of the Invention

The present invention relates to electrical outlet protectors and, more particularly, to a sheath for enclosing and protecting an electrical plug plugged into an electrical outlet.

2. Description of Related Art

Electrical outlets, whether for residential or commercial purposes, are often located outdoors to provide a source of electrical power. The outdoor environment inherently subjects the electrical outlets to moisture through condensation, water from rain or splashing, and to debris. Most outdoor electrical outlets have covers for shielding the outlets during nonuse. Such covers work reasonably well. However, when an electrical plug is plugged into the outlet, the outlet cover is usually ineffective in protecting either the outlet or the plug from water and other substances that may create an electrical hazard. A danger is thus presented to users of electrical outlets.

Various types of covers for shielding electrical plugs plugged into an electrical socket exist. For the most part, such covers are limited to use with a specific size or number of electrical outlets. Moreover, the configuration of the electrical plug which will fit within the confines of the cover is limited. In certain cases, even the diametric dimension of the electrical cord emanating from the electrical plug may be a limiting factor in use of a certain type of cover.

The known covers for shielding plugged in electrical plugs are of rigid construction and usually extend a substantial distance from the associated electrical outlet. The protrusion presented by the cover subjects the cover to damage from passers by, transport of equipment, etcetera. Since the covers are rigid, breakage is the usual result unless they are extremely robust in which case the electrical outlet may be damaged. Damage to the electrical outlet creates an immediate electrical hazard.

SUMMARY OF THE INVENTION

A flexible sheath includes a first end secured to a socket encircling wall. An electrical plug and accompanying electrical cord is insertable through a second end of the sheath for plugging into the socket. A drawstring or a hook and loop attachment interior of the sheath is provided to neck down the first end of the sheath in weather tight configuration about the socket encircling wall. A hook and loop attachment disposed interior of the sheath is provided at the second end to maintain it weather tight about the cord. In the absence of an electrical plug, the sheath may be housed within the confine defined by the socket encircling wall or the second end may be completely closed.

It is therefore a primary object of the present invention to provide a flexible sheath for protecting an electrical outlet and a mating electrical plug.

Another object of the present invention is to provide a weather tight enclosure for a mated electrical plug and socket.

Still another object of the present invention is to provide a flexible sheath for accommodating any of a plurality of differently sized electrical plugs plugged into an electrical socket.

Yet another object of the present invention is to provide a flexible resilient sheath having a first end secured to an electrical socket and a second end encircling an electrical conductor extending from a plugged in electrical plug, which second end is closed upon itself by interiorly mounted hook and loop fastening means.

A further object of the present invention is to provide a flexible sheath for simultaneously protecting each of a plurality of electrical plugs one or more of which may be plugged into a corresponding electrical outlet.

A still further object of the present invention is to provide an inexpensive flexible sheath for shielding an electrical socket and mated electrical plug and forming a weather tight seal about an electrical cord extending from the electrical plug.

A yet further object of the present invention is to provide a method for shielding an electrical plug plugged into an electrical socket.

These and other objects of the present invention will become apparent to those skilled in the art as the description thereof proceeds.

BRIEF DESCRIPTION OF THE DRAWINGS

The present invention will be described with greater clarity and specificity with reference to the following drawings, in which:

FIG. 5 illustrates a variant sheath in use;

FIGS. 6*a* and 6*b* illustrate pressure sensitive elements for attaching opposed ends of the variant sheath; and FIG. 7 is a cross sectional view taken along lines 7—7, as shown in FIG. 6.

DESCRIPTION OF THE PREFERRED EMBODIMENT

Figure 1:
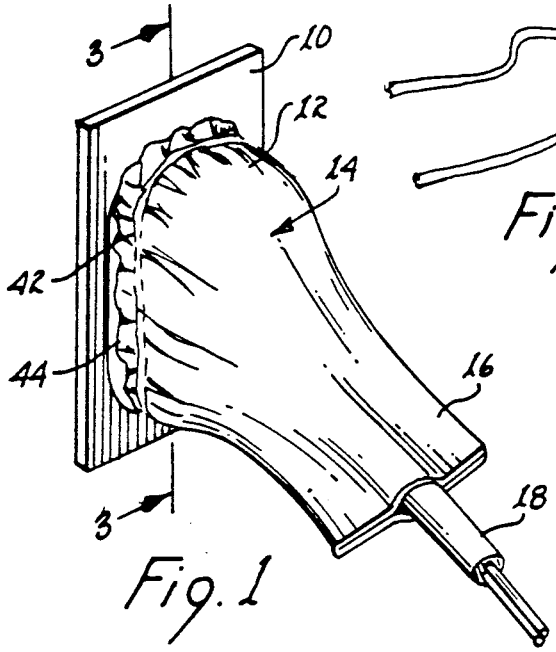
FIG. 1 illustrates a protective sheath in use.

Referring to FIG. 1, there is illustrated a face plate 10 encircling a wall mounted electrical outlet. Obviously, such outlet could also be mounted on a stanchion, cabinet, and the like. Anterior end 12 of a sheath 14 is secured to face plate 10 and extends therefrom to enclose and protect against weather the electrical socket(s) disposed in the face plate along with an electrical plug plugged into the socket. Posterior end 16 of the sheath tightly encircles an electrical conductor 18 extending from the electrical plug to seal the posterior end of the sheath.

Sheath 14 is of flexible water tight, if not water impermeable, material to prevent incursion of rain water, splashing water and other liquid or solid contaminants into the electrical socket and the electrical plug. Accordingly, sheath 14 provides at least a weather tight enclosure to eliminate an electrical hazard that might otherwise be presented.

Referring jointly to FIG. 1, 2*a*, 2*b*, 3 and 4, further details attendant face plate 10 and sheath 14 will be described. An electrical outlet box 20 extends through or from a wall member 22 to support an electrical socket or sockets. Face plate 10 is secured to the electrical outlet box by attachment means, such as screws 24. A wall 30, which may be continuous, as illustrated, or segmented extends from the face plate to define a channel 32 intermediate the face plate and an annular ridge 34. The wall extends about the socket or sockets into which electrical plug 40 may be plugged.

Figure 3:
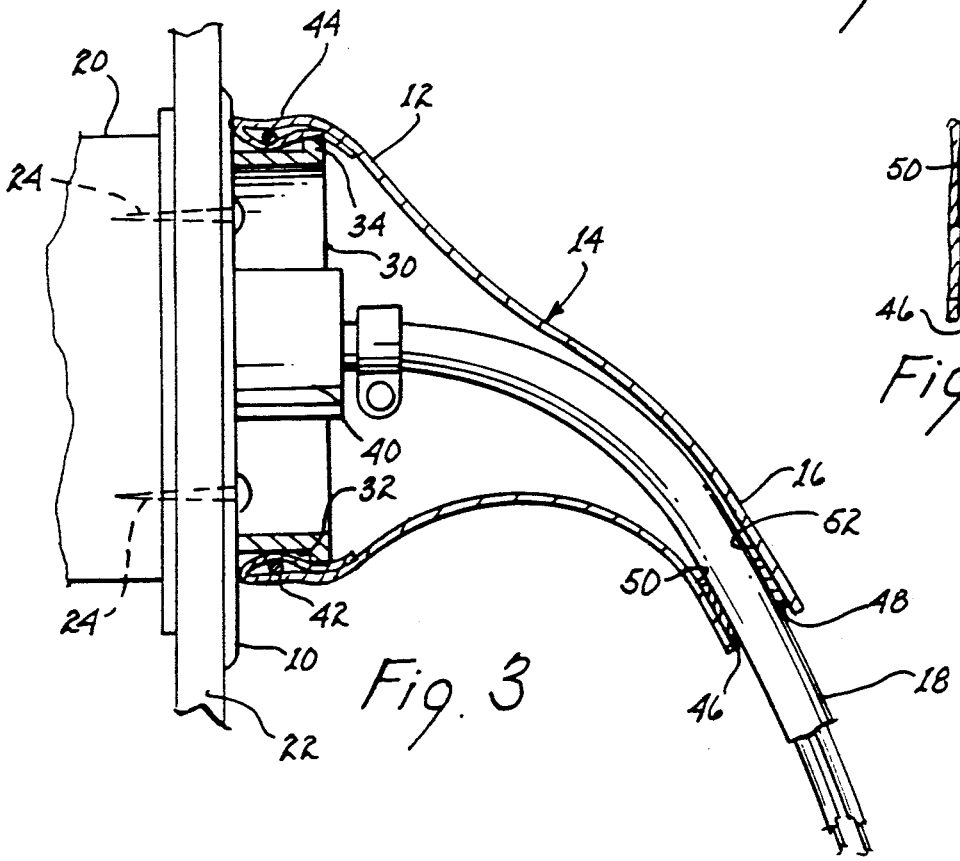
FIG. 3 is a cross sectional view taken along lines 3—3, as shown in FIG. 1.
Figure 4:
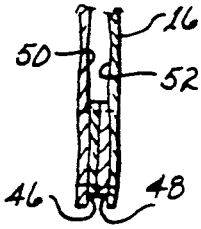
FIG. 4 is a sectional view taken along lines 4—4, as shown in FIG. 2*a;*

Anterior end 12 of sheath 14 may include a draw string 42 disposed within a tube section 44 for securing the anterior end within channel 32, as shown in FIG. 3. By drawing drawstring 42 tight, as depicted in FIGS. 1 and 3, tube section 44 will be contracted and anterior end 12 will contract and secure the anterior end within channel 32. The annular protrusion provided by ridge 34 will preclude disengagement of the anterior end from the wall.

Figure 2B:
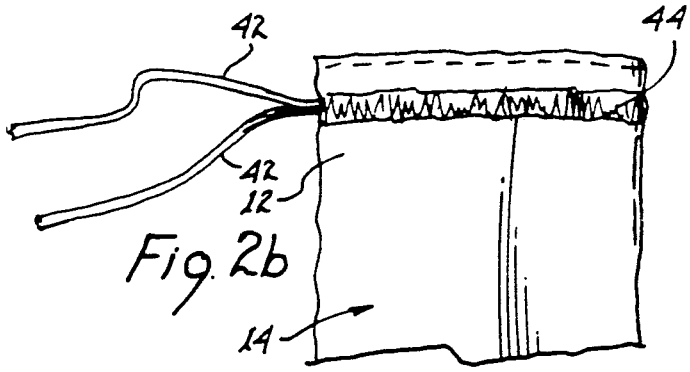
FIGS. 2*a* and 2*b* illustrate variants for attaching each end of the sheath.
Figure 2A:
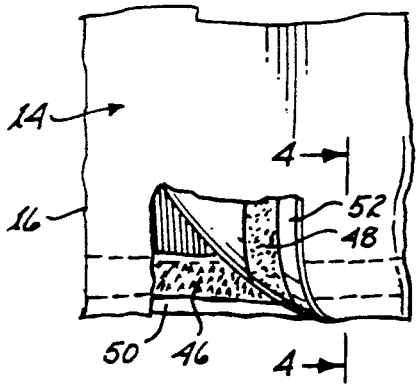

Posterior end 16 of sheath 14 includes hook and loop fastener means 46, 48 secured to opposed interior sides 50, 52 of sheath 14, as shown in FIG. 2*a*. By bringing sides 50, 52 into opposed engagement on either side of electrical conductor 18, a reasonably good weather tight seal about the electrical conductor can be achieved.

Referring to FIG. 5, there is illustrated a face plate 60 encircling a wall mounted electrical outlet and extending from an electrical outlet box 62. Anterior end 64 of a sheath 66 is secured to face plate 60 and extends therefrom to enclose and protect against weather the electrical socket(s) disposed in the face plate along with an electrical plug plugged into the socket. Posterior end 69 of the sheath tightly encircles an electrical conductor 18 extending from the electrical plug to seal the posterior end of the sheath.

Sheath 66 is of flexible water tight, if not water impermeable, material to prevent incursion of rain water, splashing water and other liquid or solid contaminants into the electrical socket and the electrical plug. Accordingly, sheath 66 provides at least a weather tight enclosure to eliminate an electrical hazard that might otherwise be presented.

Referring jointly to FIGS. 5, 6*a*, 6*b* and 7, further details attendant face plate 60 and sheath 66 will be described. Electrical outlet box 62 extends through or from a wall member 72 to support an electrical socket or sockets. Face plate 60 is secured to the electrical outlet box by attachment means, such as screws 74. A wall 76, which may be continuous, as illustrated, or segmented, extends from the face plate to define a channel 78 intermediate the face plate and an annular ridge 80. The wall extends about the socket or sockets into which electrical plug 82 may be plugged.

Anterior end 64 of sheath 66 includes hook and loop fastener means 90, 92 disposed on opposed interior sides 94, 96. Upon encircling channel 78 with the section of anterior end 64 containing the hook and loop fastener means and crimping laterally extending opposed sides 94, 96, the sheath becomes secured to wall 76. That is, the hook and loop fastener means becomes physically lodged within channel 78 and is retained therein by ridge 80, as illustrated in FIG. 7. The tight closure of opposed sides 94, 96 in combination with the mechanical lock about the wall ensures a weather tight, if not water proof. junction between the face plate and the sheath.

Posterior end 68 of sheath 66 includes hook and loop fastener means 100, 102 secured to opposed interior sides 104, 106 of sheath 68, as shown in FIG. 6*a*. By bringing sides 104, 106 into opposed engagement on either side of electrical conductor 70, a reasonably good weather tight seal about the electrical conductor can be achieved.

The mode of use of sheath 14 or sheath 68 will be described with reference to FIG. 1. For sake of simplicity, the reference numerals used in conjunction with FIG. 1 will be repeated. After anterior end 12 of sheath 14 has been secured within channel 32 of wall 30 by draw string 42 (or hook end loop fasteners 100, 102), plug 40 is inserted through open posterior end 16 for engagement with the electrical socket. After the electrical plug has been plugged in, posterior end 16 is closed about electrical conductor 18 and retained in place by bringing the hook and loop fastening means together. Upon attachment of the sheath, the electrical socket and the junction between the electrical socket and the electrical plug becomes shielded against the weather and other liquid or solid contaminants that may be or may become present. Accordingly, the likelihood of an injurious or damaging electrical shock through inadvertent contact with the electrically charged socket or plug is precluded. It may be noted that since sheath 14 and sheath 60, are flexible, inadvertent contact with the sheath by a person or objects will generally result in accommodating flexing or movement of the sheath rather than cracking or damage as may occur with a rigid protective device.

To unplug plug 40, posterior end 16 of sheath 14 is opened by pulling apart the hook and loop fastening means. The sheath can then be pushed toward face plate 10 to provide access to plug 40 through the opening in the posterior end. Alternatively an operator can reach into the sheath through the posterior end to grasp and withdraw the plug. To remove and/or replace sheath 14, the fastening means for anterior end 12 is unfastened and the sheath can be withdrawn from about wall 30.

The hook and loop fastening means may be of the type sold under the trademark Velcro. Generally, it includes a first ribbon of hooks and a second ribbon of loops, which ribbon are pressed together to obtain fastening; the ribbons may be pulled apart without damage to unfasten the ribbons from one another.

During nonuse of the electrical socket(s), the sheath, if retained upon the wall, can be stuffed within the confine defined by the wall. Such stuffing will tend to protect the shroud against damage and also serve a secondary function of shielding the electrical socket(s) from inadvertent contact or exposure to the elements.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

I claim:

1. A shroud for protecting an electrical socket and for protecting an electrical plug plugged into the electrical socket against incursion of foreign matter, said shroud comprising in combination:

a) a sheath of flexible water resistant material for discouraging incursion of water within said sheath, said sheath being of sufficient cross sectional size to accommodate insertion of the electrical plug thereinto for engagement with the electrical socket;

b) a face plate surrounding the electrical socket;

c) means for securing one end of said sheath to said face plate in encircling relationship with the electrical socket; and d) means for closing the other end of said sheath to form a barrier against incursion of foreign matter into the electrical socket, said closing means including hook and loop fastening means.

2. The apparatus as set forth in claim 1 wherein said hook and loop fastening means extends across each half of the other end of said sheath.

3. The apparatus as set forth in claim 1 including a wall extending from said face plate in encircling relationship with the electrical socket and wherein said securing means attaches the one end of said sheath about said wall.

4. The apparatus as set forth in claim 3 wherein said wall includes an outwardly facing channel for receiving the one end of said sheath.

5. The apparatus as set forth in claim 3 wherein said receiving means comprises drawstring means for fastening the one end of said sheath with said channel.

6. The apparatus as set forth in claim 1 wherein said hook and loop fastening means comprises loop means disposed along one surface of the other end of said sheath and hook means disposed along another surface of the other end of said sheath.

7. The apparatus as set forth in claim 6 wherein said loop means is disposed on a first interior surface of said sheath and said hook means is disposed on a second interior surface of said sheath, which second interior surface is opposed to the first interior surface.

8. The apparatus as set forth in claim 7 wherein the said loop means extends across on half of the other end of said sheath and said hook means extends across the other half of the other end of said sheath.

9. The apparatus as set forth in claim 1 including wall means extending from said face plate in encircling relationship with the electrical socket and wherein said securing means engages said wall means.

10. The apparatus as set forth in claim 9 wherein said securing means comprises a draw string for securing the one end of said sheath about said wall means.

11. The apparatus as set forth in claim 9 wherein said securing means comprises hook and loop fastening means for securing the one end of said sheath about said wall means.

12. The apparatus as set forth in claim 11 wherein said hook and loop fastening means comprises loop means extending across one half of the one end of said sheath and hook means extending across the other half of the one end of said sheath.

13. A method for protecting a electrical socket and for protecting an electrical plug plugged into the electrical socket against incursion of foreign matter, said method comprising the steps of:

a) securing one end of a sheath of flexible water resistant material to a face plate surrounding the electrical outlet; and b) closing the other end of the sheath to form a barrier against incursion of foreign matter into the electrical outlet, said step of closing including the step of securing the hooks with the loops of hook and loop fastening means; and c) inserting the electrical plug into the sheath to engage the electrical socket prior to exercise of said step of closing.

* * * * *